US006932668B2

(12) United States Patent
Digby et al.

(10) Patent No.: US 6,932,668 B2
(45) Date of Patent: Aug. 23, 2005

(54) METHOD FOR A CUSTOMER-CONTROLLED STUFFED TOY

(76) Inventors: Roger B. Digby, 12406 NW. 112th Ave., Alachua, FL (US) 32615; Patricia A. Digby, 12406 NW. 112th Ave., Alachua, FL (US) 32615

( * ) Notice: Subject to any disclaimer, the term of this patent is extended or adjusted under 35 U.S.C. 154(b) by 0 days.

(21) Appl. No.: 10/425,244

(22) Filed: Apr. 29, 2003

(65) Prior Publication Data

US 2004/0219862 A1 Nov. 4, 2004

(51) Int. Cl.[7] ..... A63H 3/02
(52) U.S. Cl. ..... 446/369
(58) Field of Search ..... 446/369, 71, 72, 446/73, 76, 370, 371, 372, 385

(56) References Cited

U.S. PATENT DOCUMENTS

| | | | | | |
|---|---|---|---|---|---|
| 4,509,280 | A | * | 4/1985 | Smith | 40/486 |
| D288,705 | S | * | 3/1987 | Shaffer et al. | D21/655 |
| 5,044,959 | A | * | 9/1991 | Shaver et al. | 434/236 |
| 5,182,845 | A | * | 2/1993 | Dean | 29/469 |
| 5,282,766 | A | * | 2/1994 | Fleet | 446/72 |
| 5,324,201 | A | * | 6/1994 | Friedel | 434/236 |
| 5,807,155 | A | * | 9/1998 | Divvleeon | 446/73 |
| 5,888,117 | A | * | 3/1999 | Sutton | 446/267 |
| 5,944,577 | A | * | 8/1999 | Yanofsky et al. | 446/371 |
| 5,989,095 | A | * | 11/1999 | Wotton | 446/385 |
| 6,527,617 | B1 | * | 3/2003 | Capozzi et al. | 446/369 |
| 2002/0168919 | A1 | * | 11/2002 | Perkins | |
| 2003/0077978 | A1 | * | 4/2003 | Beige | |

OTHER PUBLICATIONS

"Want a Teddy Bear? Built It, Too", Washingtonpost.com Staff, Sep. 1, 1999.*
Build–A–Bear Brochure.

* cited by examiner

*Primary Examiner*—Derris H. Banks
*Assistant Examiner*—Faye Francis
(74) *Attorney, Agent, or Firm*—Michael E. Mauney

(57) ABSTRACT

A customer-controlled method of stuffing a toy which provides a multi-media interactive experience for a customer that enhances the overall pleasure of purchasing a stuffed toy. A tangible embodiment of a personality is chosen by a purchaser. The tangible embodiment of a personality is physically incorporated into a stuffed toy form. The stuffing is blown into the stuffed toy form and the stuffing process is, in part, controlled by a purchaser while providing a multi-media experience including music, lights, decorations, and pressurized air. A pressure pad is controlled by a customer's feet which activates the stuffing process. The stuffed toy is taken to a separate room where a multi-media light show using special glass, lasers, and other light effects apparently bring the toy to life in response to actions of the customer. The customer chooses a name for the toy and grooms the toy, giving the customer a unique toy with the unique personality chosen by the customer and apparently brought to life by the customer, thereby enhancing the overall experience of the customer in obtaining the stuffed toy.

20 Claims, 6 Drawing Sheets

METHOD FOR A CUSTOMER-CONTROLLED STUFFED TOY

FIELD OF THE INVENTION

This invention relates generally to a customer-controlled method of stuffing a toy which provides a multi-media interactive experience for a customer, particularly a child, that enhances the overall pleasure of purchasing a stuffed toy.

BACKGROUND OF THE INVENTION

Stuffed toys known as teddy bears originated in approximately 1902 when the then President, Theodore Roosevelt, refused to shoot a bear on a hunting trip in Alabama. A newspaper picked the story up, called the lucky bear a "Teddy Bear" and soon a craze developed. Over the years, teddy bears have come in many sizes and shapes and have evolved beyond the simple stuffed bear. As the form of the stuffed toy has evolved, the ways of making and marketing the stuffed toys have also evolved. They go from very inexpensive stuffed toys that may be given as a prize at a carnival game to very expensive stuffed toys, one brand is called "Gund", that may be collectible. One company has sold stuffed toys by producing a story that accompanies the toy and making them in limited numbers. This has made these toys collectible. They are commonly known by the trademark "Beanie Babies™."

One particular way that has been employed to sell stuffed toys and to provide an enhanced experience for a customer takes place in shops that offer a customer an opportunity to be involved in the choice of the form and making of the stuffed toy. Perhaps the most widely known of these shops employing such a method to build and sell a stuffed toy is a company that goes by the trade name "Build-A-Bear." In this particular store, a customer is shown a variety of finished stuffed toys and picks a particular empty stuffed toy form to be stuffed. The unstuffed form is taken to a standardized stuffing machine. While the customer looks on a foot pedal on the stuffing machine is used to control the flow of stuffing material from the stuffing machine. A customer may be invited to press the foot pedal. An employee of the store will place a tube into an opening in the unstuffed toy form. As the foot pedal is employed, compressed air blows a raw cotton-like filling into the form which gradually fills the form to give the finished stuffed toy a satisfactory amount of stuffing. The "Build-A-Bear" experience then includes enclosing within the now stuffed toy a red, heart shaped, small cushion approximately the size of a silver dollar. This is the "heart" of the stuffed toy. The toy is then closed off by lacing the toy up in the back. The customer then has the opportunity of going to a computer screen and entering information into a set of fields on the computer screen which then produces a printed certificate that memorializes the purchase of the stuffed toy and which, for marketing reasons, is called a "Birth Certificate." The customer will be given an opportunity to groom the stuffed toy and to buy accessories for the toy. At the time it comes to pay for the customer's purchases, the toy will be placed inside a particular type of box characteristic of, and perhaps unique to, the "Build-A-Bear" store. This method builds upon and utilizes the desire of a customer, especially a child, to be a part of the overall experience and to feel that their particular stuffed toy is unique. It is this illusion of uniqueness which gives extra value to the stuffed toys that are sold in the "Build-A-Bear" venue as opposed to a standard store with bins of standard stuffed toys. This notion of uniqueness, or at least specialness, is also part of the reason for the widespread success of the "Beanie Babies™" where each particular edition of a "Beanie Baby" would be accompanied by a particular story and there would be sold in a limited edition. Once that particular edition was sold out, there would be no more babies made of that type.

These types of stuffed toys and the marketing of these stuffed toys to some degree play on a well known human characteristic of ascribing human traits to animals or inanimate objects. This trait is commonly called anthropomorphism. Human traits are frequently ascribed to animals, so when one uses terms like "proud", "angry", "vengeful", "loyal", and the like to describe an animal, it is commonly believed that these terms are misnomers and that in fact animals are acting instinctively. (Many pet owners might disagree.) But, certainly, when a captain describes his ship as "stubborn", or when a computer is described as "stupid", people are ascribing human characteristics to inanimate objects that clearly do not have those characteristics. It is part of growing up that children learn to distinguish themselves from the outside world and to not ascribe their own characteristics and motivations to things other than human beings. However, it is characteristic of childish thinking to believe that the world is like a child, thus "Beanie Babies" and "Build-A-Bear" to some degree seek to capitalize on this known characteristic of children by ascribing known human qualities to the inanimate objects they sell. Each "Beanie Baby" comes with a story. "Build-A-Bear" places a "heart" inside of each stuffed toy and provides a "birth certificate" in addition to or opposed to a bill of sale. Thus, it is understood that it is a useful characteristic of a toy that the toy be unique for a particular customer and that a customer, especially a child, should be encouraged to ascribe human characteristics to that toy. Despite the recognition of the value of providing both the illusion of uniqueness and the illusion of human characteristics to a toy, there is still much work that can be done to capitalize on these known human traits to provide a customer, especially a child, with a stuffed toy with apparently unique human characteristics chosen by the child for that toy.

SUMMARY OF THE INVENTION

It is the object of the current invention to provide a broad experience that involves the customer's sight, sound, touch and to a lesser degree the customer's sense of smell so that a stuffed toy is "built" by the customer and "brought to life" by the customer so as to capitalize to the maximum extent on a customer's, especially a child's, tendency to ascribe human qualities to the stuffed toy.

In the method of the current invention, a customer, ordinarily a child, will be provided with a wide variety of unstuffed toy forms to choose from. Once a child has chosen a particular unstuffed toy form, the child is directed by the store design to an area where a "personality" will be chosen for that stuffed toy. The chosen "personality" will be some tangible manifestation which can be incorporated in the stuffed toy. Typically this will be a written description of the personality that will be inside the stuffed toy before it is stuffed. Here the written personality description may be chosen by the customer. In the particular embodiment described as follows, a table is set up with a wide variety of decorative ribbons on which positive personality characteristics are printed. These could include such things as "happy", "funny", "giggly", "silly", "loving" and so on. The customer can choose one or more of these characteristics to be made a part of their stuffed toy. A portion of the ribbon will be pulled from a roll, the customer handed a pair of scissors and asked to cut off that portion of the ribbon with that particular personality characteristic. Because a substantial number of rolls of ribbon are employed, a customer may choose several different characteristics so it is unlikely any other customer would have chosen precisely the same combination of characteristics. Additionally, blank ribbons are provided with permanent marking pens so that if a customer decides to choose a personality characteristic not presented in the printed ribbons, that personality characteristic can be written on the blank ribbon and the blank ribbon incorporated in the stuffed toy.

Once the personality choice is made and the tangible manifestations of the personality choice placed inside the unstuffed toy, the customer next goes to an area for stuffing the toy. Here the large machines that are employed to place stuffing fill inside of the toy will be decorated with a particular theme. For example, a circus theme might be chosen for the entire store. Other themes with positive attributes like a carnival, a zoo, an amusement park or the like could be employed. The particular theme is not as important as it is that a general theme be employed that it be a positive one and that the child be encouraged to become involved in the process, in part, by the theme chosen. In the particular embodiment described in this application, the stuffing machines are decorated in a circus theme. They look not unlike a circus wagon which are typically decorated with colorful embellishments, gilt filigrees and patterns and the like. The stuffed toy will be placed on a filling pipe and compressed air is employed to blow fill from the filling machine through the pipe into the stuffed toy. However, the compressed air is at least in part controlled by a pressure pad decorated in keeping with the theme employed on the machine and a customer is encouraged to stand on the pad, to dance, to jump up and down or to shift weight in a way that will cause the stuffed toy to be filled. In this way, the customer is given the illusion that he or she is the one controlling the filling of the stuffed toy. Next, the traffic flow of the store design takes the customer to a "birth" room.

This "birth" room is enclosed. Within that room special lighting and sound effects are employed to apparently bring the stuffed toy to life. Nowadays, the use of coherent light sources like lasers can be used along with partially silvered mirrors, blue screens, video projection equipment and other technologies so that a child, unsophisticated in these technologies, will apparently "see" the toy brought to life with a beating heart, with other special lights and other special effects that will encourage the child's imagination to willingly suspend the child's disbelief in an inanimate object being "brought to life".

When one leaves the "birth" room where the stuffed toy is apparently brought to life, one moves to an area where the toy may be groomed, outside fill material removed, the outside furlike covering of the stuffed toy fluffed up using compressed air. This grooming area is also designed in keeping with the theme established for the particular store, be it a circus, zoo, or whatever. While the compressed air could be scented in a particular way, ordinarily it will be unscented, but the compressed air blowing through the "fur" of the stuffed toy will provide a sensory experience through the child's or customer's sense of smell. The feel of the "fur", the cool compressed air, the smell of the "fur", and the sights and sounds involve four of the five senses of the child during the entire experience. After the stuffed toy is groomed, a child goes to an area where information is taken from the child so that a printed "birth certificate" can be provided. This allows the child the opportunity to name stuffed animal, again adding to the illusion that this is a special, unique stuffed toy chosen by the particular customer, imbued with particular personality characteristics by the customer, brought to life by the customer so that the customer is bonded to that stuffed toy in a way not possible in ordinary stores selling stuffed toys.

DETAILED DESCRIPTION OF THE DRAWINGS

Figure 1:
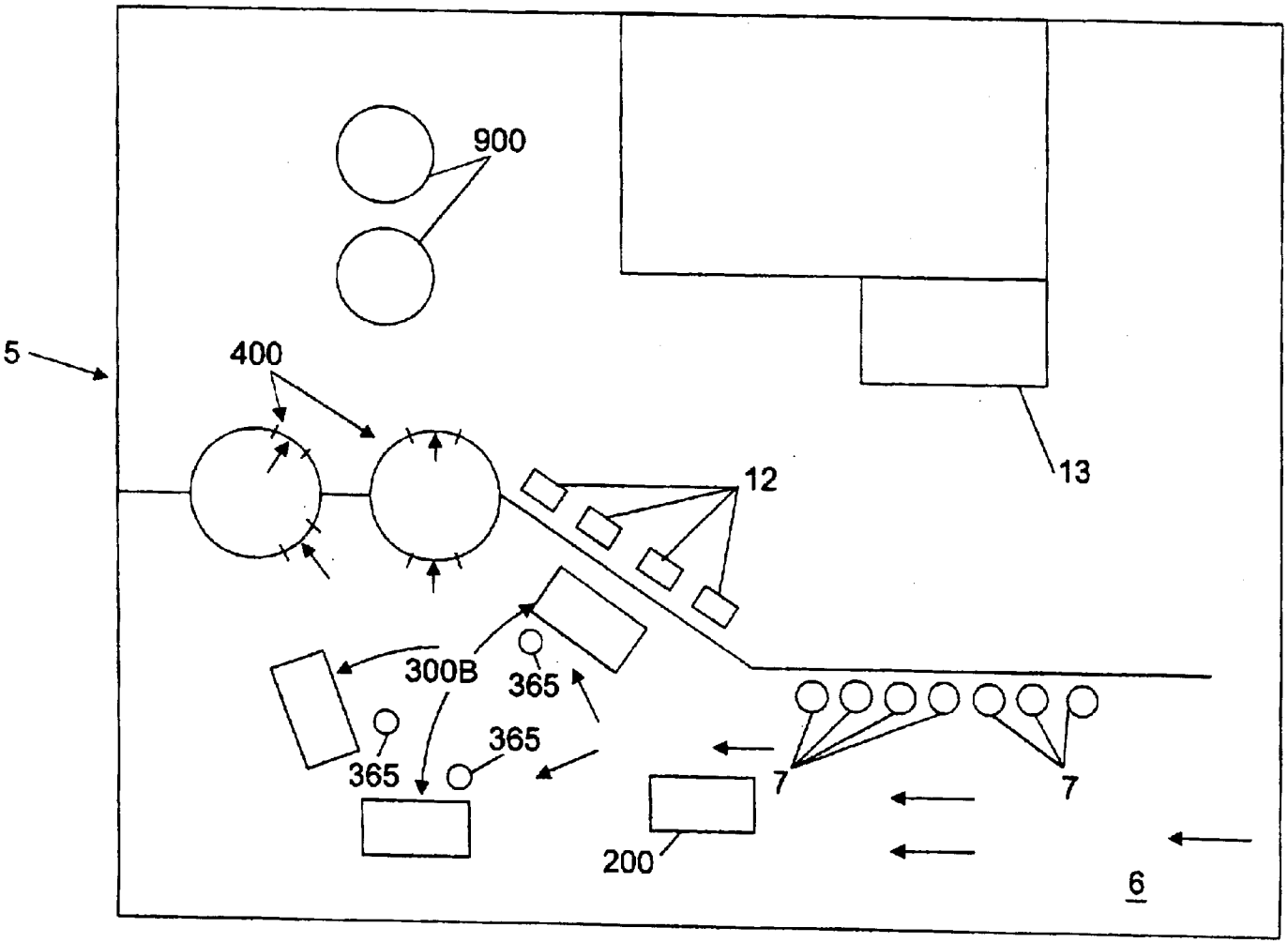
FIG. 1 shows a layout of a store employing the current method invention.
Figure 2:
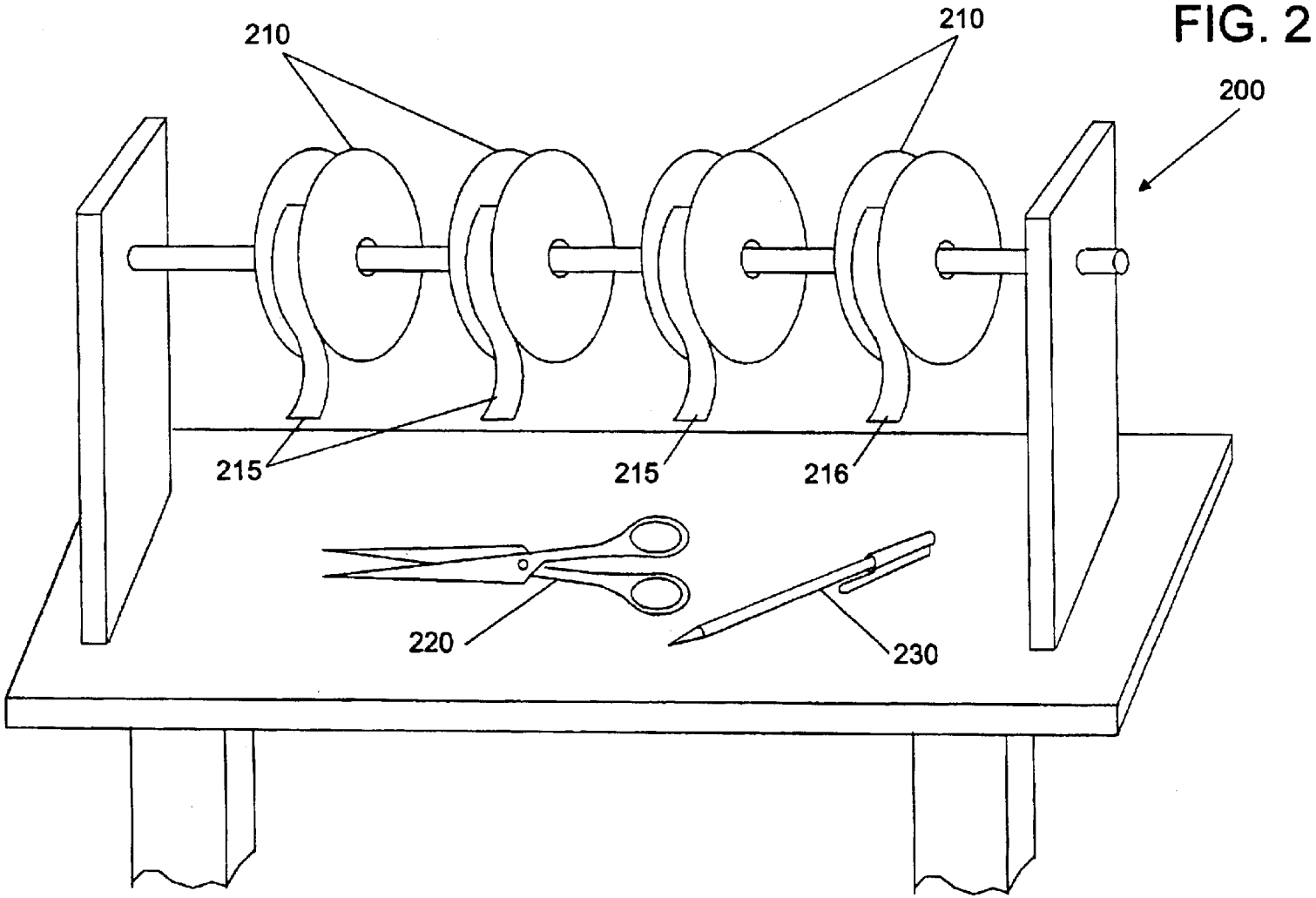
FIG. 2 shows a table top with "personality" ribbons.

The current invention is a method for involving a customer in the actual process of choosing and filling a stuffed toy in such a fashion as to maximize the customer's experience to make a stuffed toy with unique attributes and to give a customer a sense of creating a stuffed toy so that the customer will have a greater emotional involvement in the stuffed toy than would be the case in a conventional store purchase. FIG. 1 shows from above one potential layout for a store employing the method of the invention. The store (5) has an entry way (6). People enter and are routed by the store layout in the direction shown by the arrows. To a customer or purchaser's immediate right are toy bins (7) filled with unstuffed toy forms. The customer then proceeds to the personality place (200) after picking a stuffed toy. At the personality place (200) which is described in more detail in FIG. 2, a customer picks a personality for the toy which is then ordinarily incorporated in the toy prior to the customer's proceeding to the themed stuffing machines (300B). The customer will use the remote pressure pad (365) to participate in the stuffing of the toy form. The customer then proceeds to one of the "wake me up" places (400) to bring the stuffed toy to life. Finally the customer goes to the grooming station (900) where the toy is groomed with compressed air. The customer finally proceeds to computer kiosk where a "birth certificate" is prepared for the toy which includes the name for the toy so this is typically called the "naming place" (12). At this point the customer has completed the process of entering the store, picking a stuffed toy form from bins, choosing a personality for the toy, participating in filling the toy, waking the toy up, grooming the toy, and naming the toy. The only thing left is to pay for the toy in the check-out station (13) shown in the store. There will be an opportunity for auxiliary purchases as well. Photographs may be taken. Clothes for the toy may be purchased. Other accessories for the toy in addition to clothes and the like may be purchased. However, this aspect of the experience are common commercial aspects, shared with other stores which have an on site stuffing of a chosen toy form. The entire store will be decorated in keeping with a particular theme. For example, the areas shown could all be enclosed within a canvas tent-like structure to appear to be a circus tent. All the decorations could have circus themes or characteristic circus decorations. Other themes could be employed.

The customer picks a particular unstuffed toy form from bins (7) (seen in FIG. 1) that contain unfilled forms of particular toys. This process is employed in businesses called "Build-A-Bear" or similar businesses. However, in the method employed in this invention, before the toy is actually stuffed the customer will go to a personality place (200) shown in FIG. 2. There a plurality of rolls (210) of preprinted ribbon (215) will be available. The preprinted ribbon (215) will have pre-printed on it personality attributes—such as happy, loving, funny, sweet, and so on. For some customers, they will choose from these pre-printed ribbons (215). A portion of the preprinted ribbon (215) will be pulled from the roll (210) and the customer will be asked to employ scissors (220) to cut the ribbon (215). In addition to the pre-printed ribbons (215) there will also be at least one roll (210) of blank ribbons (216). Pens (230) or other writing instruments will be provided which will allow the customer or, in the case of a small child, an accompanying adult to write a particular personality on the blank ribbon (216). It should be understood that the employment of ribbons with preprinted personalities or blank ribbons that can be printed by the customer is just one of a variety of choices. For example, one could have embossed plastic pieces or "dog tags" or similar items on which a printed message could be employed. Even symbolic forms could be employed. For example, a lion could be used to symbolize bravery, a lamb to symbolize mildness and sweetness, a swan to symbolize steadfast fidelity and so on. The important thing is that the customer be involved in choosing a personality and that the customer have some sense that the personality chosen is unique or at least unusual. The personality place (200) is designed not only to involve the customer in the choice of a personality, but also to involve the customer in physically cutting the preprinted ribbon (215) or in writing a message on the blank ribbon (216) and in placing the resulting "personality" inside the unstuffed toy to be incorporated inside the toy during the stuffing process. This is designed to increase the personal involvement of the customer with the toy and to involve the customer in an immediate tactile way in the actual construction of the toy.

Figure 3A:
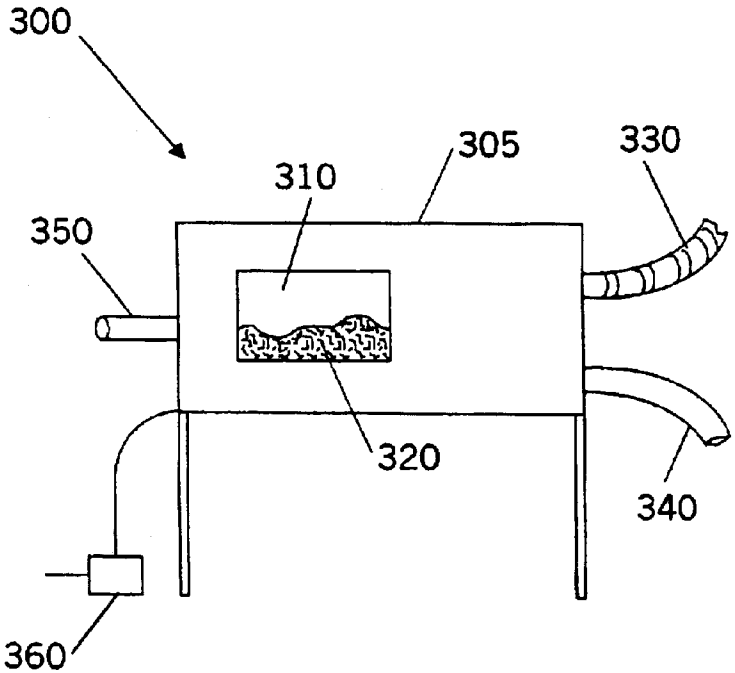
FIG. 3A PRIOR ART
FIG. 3A shows a prior art stuffed toy filling machine.
Figure 3B:
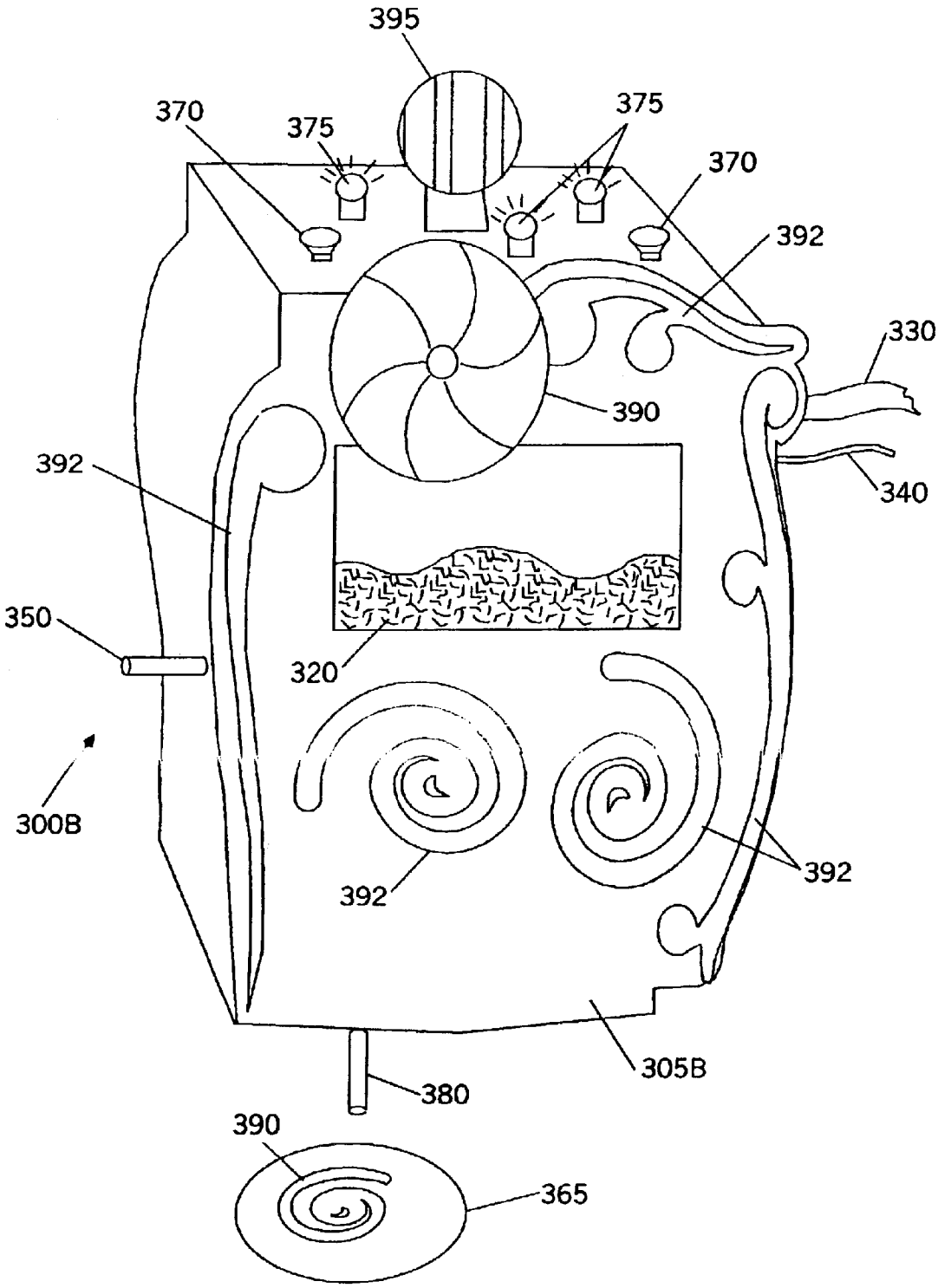
FIG. 3B shows one embodiment of a filling machine of the current invention.

FIG. 3A discloses a prior art stuffing machine (300) as seen in a side view. This is usually a large enclosed bin (305). There is a window (310) in the enclosed bin (305) that allows one to observe the fill (320) used to stuff the toy. A stuffing filler pipe (330) comes from a central area (not shown) that contains fill (320) which will replace fill (320) in the enclosed bin (305) as it is used. A compressed air source is connected to a compressed air pipe (340) which is connected to the enclosed bin (305). In the enclosed bin (305), there are oftentimes paddles or paddle wheel-like device (not shown) which rotates to agitate the fill (320) and to keep it from settling in the bottom of the enclosed bin (305). At one end of the enclosed bin (305) there is a toy filler pipe (350). An unfilled stuffed toy form will be placed onto the toy filler pipe (350). A control pedal (360) attached to the stuffing machine (300) will be operated, which will start the rotation of the paddles (not shown) within the enclosed bin (305) and will cause compressed air to flow into the enclosed bin (305) through the compressed air pipe (340), which forces air and fill (320) out the toy filler pipe (350) and into the stuffed toy form (not shown). The toy form will ordinarily be made of air permeable fabric so the air will escape but the fill (320) will remain within the toy. In this fashion, by continuously or intermittently operating the control pedal (360) a stuffed toy may be filled to an appropriate level of firmness using the fill (320). This prior art machine shown in FIG. 3A is effective and useful for filling a stuffed toy form but does not fit within the overall theme of the method of this invention. Ordinarily, a particular theme for the entire experience will be chosen. It could be the theme of a circus, a hospital, a factory, a zoo, or any other suitable venue with known attributes which can create a favorable impression on a customer. In FIG. 3B, the themed stuffing machine (300B) is shown. Again an enclosed bin (305B) is seen in one embodiment of the current invention with a "circus" theme. Here the enclosed bin (305B) is decorated to look like a circus wagon. As before, there is a toy filler pipe (350), a compressed air pipe (340), and a stuffing filler pipe (330). However, in this invention there is a remote pressure operated touch pad (365). Here the customer is required to stand. The remote pressure pad (365) responds to variation in the customer's weight to activate the enclosed bin (305B). The remote pressure pad (365) operates not only the paddles (not shown) within the enclosed bin (305B) to agitate the fill material (320), but it also causes speakers (370) to produce appropriate music or sound effects. Lights (375) light up in an appropriate fashion in response to pressure applied by a customer to the remote pressure pad (365). A display (390) can rotate, can show colors, can produce written or text messages, or can do other things to enhance the overall experience for a customer in response to pressure on the remote pressure pad (365). As air pressure is activated to operate the toy filler pipe (350) by the remote pressure pad (365), an extra air pipe (380) directs an air stream at the at the customer on the remote pressure pad (365). If the customer chooses to dance in a rhythmic fashion, it may be possible to coordinate the speakers (370), lights (375), air pipe (380) and display (390) to respond to the rhythm of the customer's motions on the remote pressure pad (365). In short, the themed stuffing machine (300B) not only serves to fill a stuffed toy form through the toy filler pipe (350), but does so only in response to the variations of pressure on the remote pressure pad (365) operated by a customer. It also produces a light, sound, air and motion effect to memorialize the experience for a customer and to provide a greater sense of participation in the filling of the stuffed toy form through the toy filler pipe (350) through the light, sound, motion, air or other themed effects. To enhance the overall effect for a customer, the themed stuffing machine (300B) has various cladding and decorative effects (392) spaced around and on the side of the enclosed bin (305B) so that it does not appear to be a simple box. A spiral-like theme may be employed on some of the decorative cladding (392) and a spiral clad decoration (390) also appears on the remote pressure pad (365). A balloon (395) is attached to the top of the enclosed bin (305B). The colors used on the enclosed bin (300B), on the decorative cladding (392), on the balloon (395), and on the display (390) are all designed to be coordinated and to fit within the overall theme of a particular store. Shown here is a circus wagon theme but other themes could be employed to coordinate with what is the chosen theme for the overall experience. The careful coordination of ideas and decorations to the theme of the overall experience is part of the especially memorable experience provided by the current invention.

Figure 4:
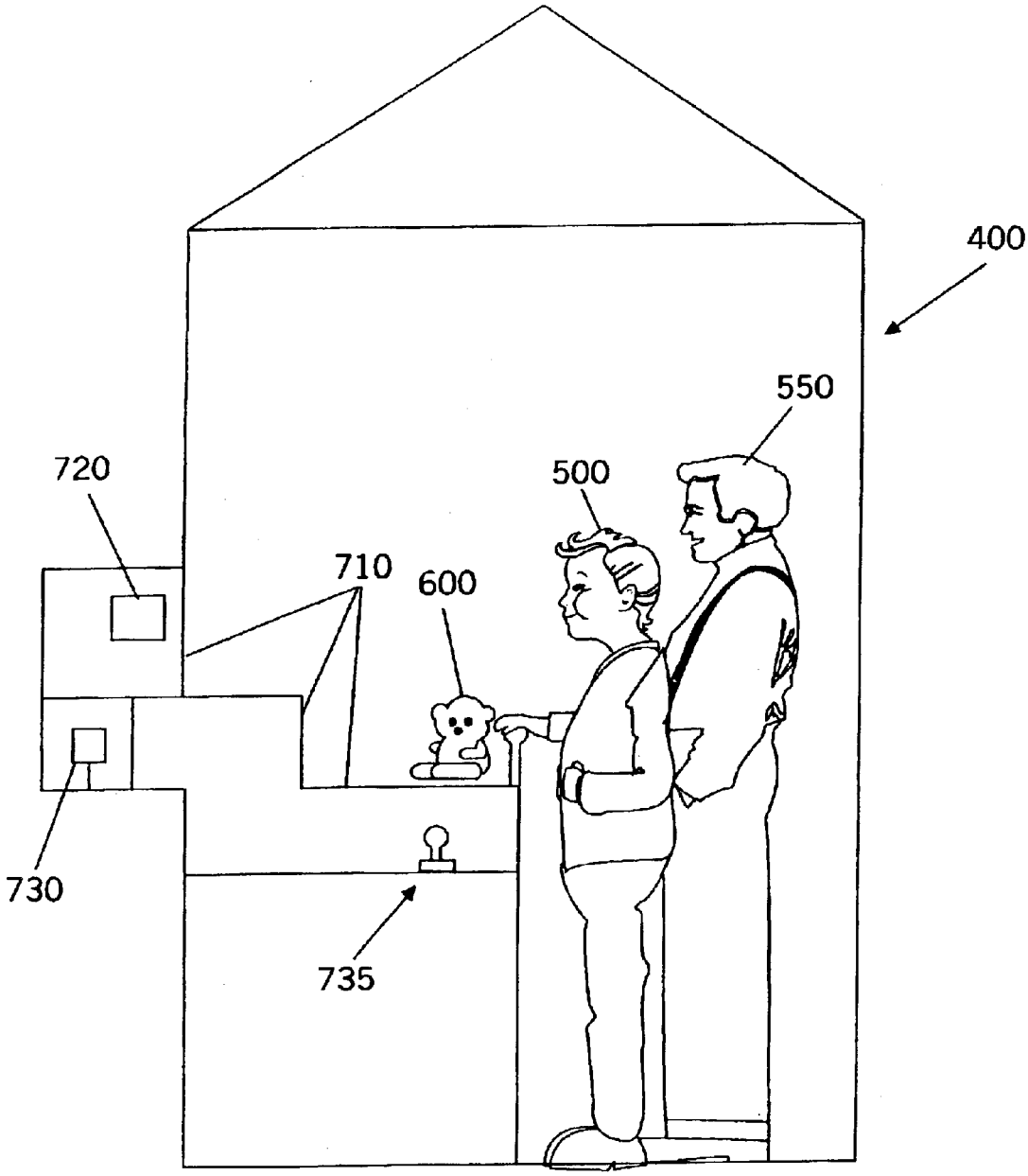
FIG. 4 shows the "wake up" room in cross section.

For a child (500), shown for the first time in FIG. 4, a stuffed toy (600) may assume many of the attributes of a live, animate friend or animal. The stuffed toy (600) may be given a name and the child (500) may project particular feelings or personality attributes on the stuffed toy (600). In the "magical" kind of thinking that is common in a small child, the child (500) may pretend the stuffed toy (600) is alive. In order to capitalize on this attribute of children and to increase the pleasure a customer/child (500) may have from his or her particular stuffed toy (600), a themed multi-media birth experience has been devised as is shown in FIG. 4. After the stuffed toy (600) is stuffed, as is shown in FIG. 3A, the child (500) takes the stuffed toy (600) to a small enclosed room with an appropriate themed name like "wake me up place" (400). In the "wake-me-up place" (400) the child (500) participates in an illusion of bringing the stuffed toy (600) to life. In this embodiment the stuffed toy (600) is placed on a piece of two-way glass (710). The precise layout of the placement of the stuffed toy (600) can be better seen in FIG. 5, a view of the "wake-me-up place" (400) seen from above. Here, in order to show the apparatus and the lighting effects provided in the "wake-me-up place" (400) is shown partially in cut-a-way. There is a panel of two-way glass (710) in front of the stuffed toy (600). There is also two-way glass (710) to the sides of the stuffed toy (600) which are not shown in this view but can be seen in FIG. 5. A child (500) stands behind the stuffed toy (600) with the back of the stuffed toy (600) toward the child (500). However, the child (500) can see the front of the stuffed toy (600) reflected in the two-way glass (710). Concealed behind portions of the two-way glass (710) are a camera (720), a fiber optic light source (730), and a light source (735). The fiber optic light source (730) and the camera (720) are in a darkened area behind the two-way glass (710) so they remain unseen by the child (500). The child (500) sees the image of the stuffed toy (600) in the two-way glass (710). As the experience proceeds, the fiber optic source (730) can project images onto each side of the two-way glass (710). These effects projected by the fiber optic light source (730) can include sparkling lights, stars, or particular images such as a heart. Thus, from the point of view of the child (600), as the experience from the "wake-me-up place" (400) room proceeds, a recorded voice may prompt a child (500) to take certain actions in response to the lighting effects seen in the two-way glass (710). Thus, the voice might ask the child (500) to hold his toy or to love his toy, which would increase the intensity of the lighting effects generated by the laser fiber optic source (730) and the standard light source (735). The fiber optic light source (730) along with the light source (735) can be combined with lasers which, along with the two-way glass (710), can provide a unique experience apparently, if not actually, generated by the child's (500) emotions. The use of a two-way glass (710) or partially silvered mirror with particular types of light sources on one side and a customer or client on the other side is used for special effects in theme parks by magicians or by others in effects where a particular kind of lighting effect is desired. A camera (720) is employed to take a photograph through the two-way glass (710) which will capture in a photo the child (500), an adult onlooker (550), and the stuffed toy (600). If a digital camera (720) is used, a digital photograph may be sent through a network to a full color printer where a color print of the child (500) and stuffed toy (600) may be provided as part of the overall experience.

Figure 5:
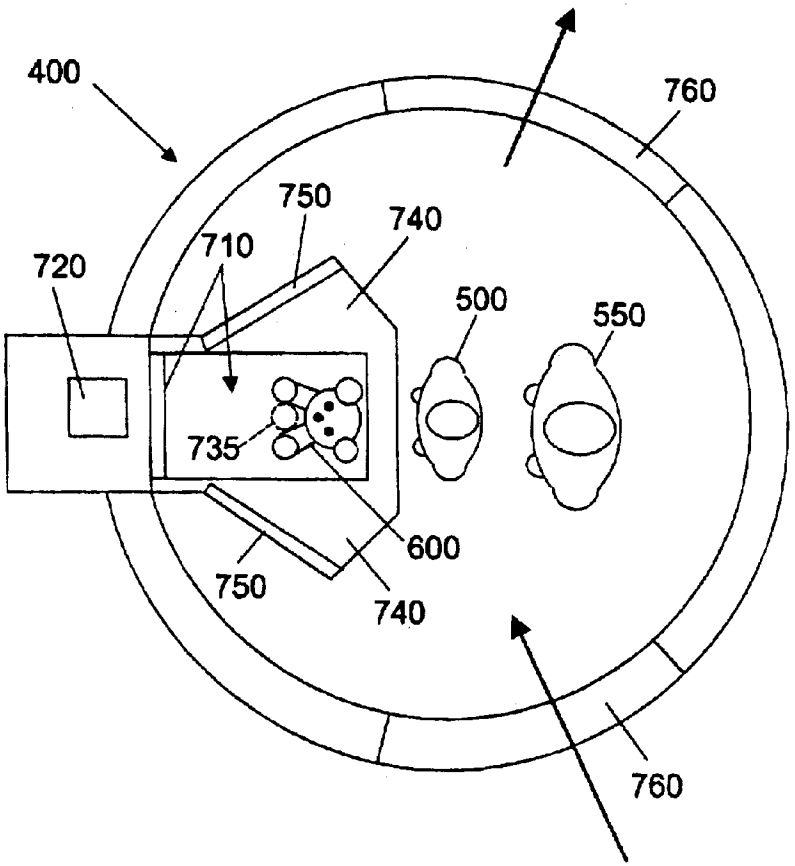
FIG. 5 shows the "wake-up" room from above.

FIG. 5 shows the "wake-me-up place" (400) seen from above. Here, the child (500) stands behind the stuffed toy (600) which rests on a piece of two-way glass (710). Unseen beneath the two-way glass is a light source (735) which can provide lighting effects. A flat shelf area (740) is disposed above the two-way glass (710) on which the stuffed toy (600) rests. This can be appropriately decorated as part of the overall theme. Walls (750) rise above the sunken area where the stuffed toy (600) rests on the two-way glass (710) which, again, can be employed as part of the overall experience by providing themed decorations. The camera (720) is behind a vertical piece of the two-way glass (710) directly facing the stuffed toy (600) and the child (500). This camera (720) can take a photograph through the two-way glass (710) catching a front view of the stuffed toy (600) and of the child (500). Pocket doors (760) slide within the walls of the room forming an entryway shown by the arrow entering the room and an exit shown by the arrow leaving the room. The fiber optic light source (730) (not seen in this view) is ordinarily below the camera (720) and projects effects onto the vertical two-way glass (710). The light source (735) is below the horizontal two-way glass (710) and can also project various effects. An apparent heart-shaped light appears on the image of the stuffed toy (600) as seen in the vertical two-way glass (710). The heart can begin to beat, while at the same time stars, sparkling lights, "pixy" dust, or other apparent visual effects can also be seen on the vertical two-way glass (710) and on the horizontal two-way glass (710). These effects produced by the light source (735) and the fiber optic light source (730) (not shown) can cause a willing suspension of disbelief in the child (500) or at least a child of appropriate age or imagination. The camera (720) is ideally placed to photograph, thus, memorialize the delight in the face of the child (500) as the stuffed toy (600) is apparently brought to life by the emotions the child (500) is experiencing in the "wake-me-up place" (400).

Figure 6:
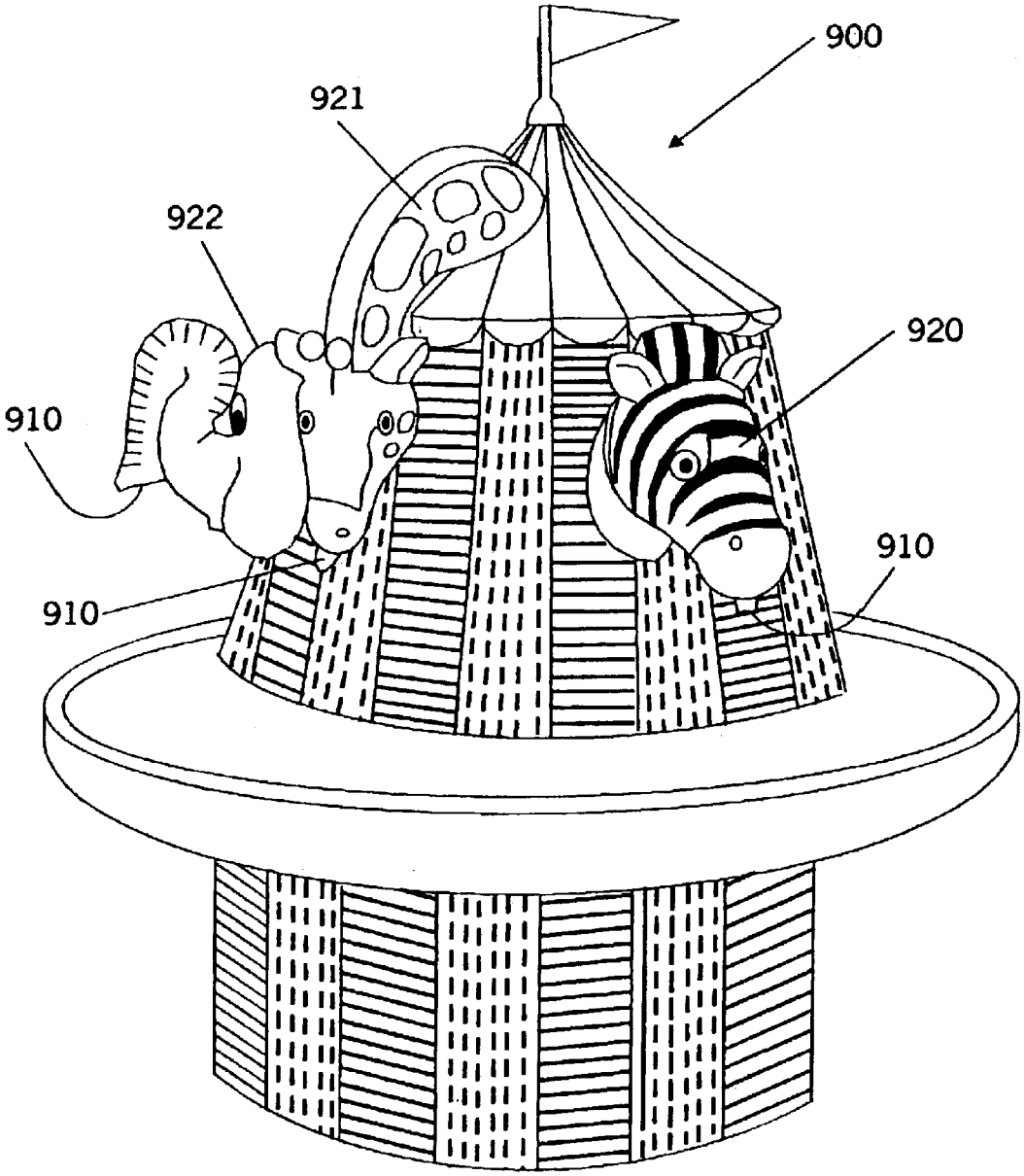
FIG. 6 shows the grooming area of the current invention.

FIG. 6 shows the grooming area (900) in the process where a newly stuffed toy that has been brought to life in the "wake-me-up place" (400) may be groomed by the purchasing child. Typically, this is done with a compressed air pipe (910). The compressed air is blown onto the toy which tends to fluff-up the apparent fur on the outside of the stuffed toy. However, rather than using a simple stuffed air pipe, the theme of the experience may be enhanced and continued for a purchasing child (500) (not shown) by use of specific cartoon characters in keeping with the theme of the particular method being employed. Here, an elephant (922), a giraffe (921), and a zebra (920) are employed with the compressed air pipe (910) extending from the face respectively of the zebra (920), giraffe (921), and the elephant's (922) trunk. While the particular choice of character is largely a commercial decision, the use of some character and some theme is part of carrying out the overall experience of the invention. It is believed if a consistent theme is employed, be it a hospital, a zoo, a circus, or whatever and appropriate characters are chosen for that theme, the overall experience will be enhanced. Here, the choice of the zebra (920), the giraffe (921), and the elephant (922) are in keeping with the circus theme employed in FIG. 3B. In keeping with the overall circus theme of the particular preferred embodiment as shown in FIG. 3B and FIG. 6, the grooming area shown in FIG. 6 is shaped approximately like a circus tent with characteristic circus animals, such as a giraffe, an elephant, and a zebra, employed as the instrument for positioning the compressed air pipe (910). The compressed air employed could be scented to add to the theme experience.

In the particular embodiment shown in the foregoing figures, a circus theme is employed. This is a suitable theme for the overall experience. Circuses are associated with pageantry, clowns, and fun. Here, the theme chosen includes a circus tent, a circus wagon, and a cast of animal characters that might be typically found in a circus, such as a zebra, an elephant, or a giraffe. However, it will be appreciated by one of skill in the art that a particular theme like a circus may be varied to a different theme so long as the theme chosen could be expected to have pleasant association for a customer especially a young customer. The critical part of the experience is not so much the particular theme chosen, but rather that the customer be involved in important stages of the construction of the stuffed animal. This include that the customer be given the opportunity to choose a particular personality for the animal, which is incorporated it the animal's construction. The customer is involved in the animal's construction and watches it happen while, to some extent, controlling the actual stuffing process through the devices shown in FIG. 3B. The customer is given an imaginary opportunity to bring the stuffed toy to life in the "wake-me-up place" (400). Finally the customer is given the opportunity of grooming the stuffed toy in a way that particularly employs the themes and reinforces the overall experience. The overall themed experience, be it a circus or some other theme, provides a unique experience to a customer in which the customer participates and feels a part of the process. This gives added value to the stuffed toy, which is an important business goal.

We claim:

1. A method for providing a sensory experience of producing a stuffed toy for a purchaser of a stuffed toy comprising:

(a) providing a plurality of unstuffed toy forms;

(b) allowing a purchaser to choose at least one unstuffed toy form;

(c) providing a plurality of tangible embodiments of distinct tangible personality attributes;

(d) allowing a purchaser to choose at least one said tangible embodiment of personality attributes to be placed inside of said unstuffed toy form;

(e) stuffing said unstuffed toy form using a stuffing machine after said at least one tangible embodiment of personality attributes placed inside said unstuffed toy form;

whereby said purchaser participates in choosing said tangible personality attributes for the stuffed toy and in placing said tangible personality attributes inside the stuffed toy thereby enhancing said sensory experience and satisfaction of a purchaser in purchasing said stuffed toy.

2. A method for providing a sensory experience of producing a stuffed toy for a purchaser of a stuffed toy of claim 1 wherein said plurality of tangible embodiments are a plurality of written descriptions of personality attributes.

3. A method for providing a sensory experience of producing a stuffed toy for a purchaser of a stuffed toy of claim 2 wherein said method further provides that a cutting device is used by said purchaser to cut at least one particular written description from said plurality of written descriptions for placement inside said unstuffed toy form.

4. A method for providing a sensory experience of producing a stuffed toy for a purchaser of a stuffed toy of claim 1 wherein said providing a plurality of tangible embodiments is providing blank writing and a pen for a purchaser to write out a written description of said personality attributes where by the purchaser is assured said stuffed toy has a unique personality attributes.

5. A method for providing a sensory experience of producing a stuffed toy for a purchaser of a stuffed toy of claim 1 which further includes controlling stuffing of said stuffed toy using a stuffing machine, said stuffing machine controlled by a pressure activated control, said pressure activated control at a predetermined distance from said filler pipe on said machine, said predetermined distance is at least enough so that a person in proximity to said filler pipe cannot operate said pressure activated control and said pressure activated control controlled by said purchaser of said stuffed toy.

6. A method for providing a sensory experience of producing a stuffed toy for a purchaser of a stuffed toy of claim 5 which further includes providing a distinct room wherein in said distinct room is means for providing lighting effects that can be projected onto a visual display of said stuffed toy.

7. A method for providing a sensory experience of producing a stuffed toy for a purchaser of a stuffed toy of claim 6 wherein said providing a plurality of tangible embodiments further includes said plurality of tangible embodiments are a plurality of written descriptions of personality attributes.

8. A method for providing a sensory experience of producing a stuffed toy for a purchaser of a stuffed toy of claim 7 wherein said step of controlling said stuffing further includes providing lighting and sound effects activated by said pressure activated control at a predetermined distance from said filler pipe on said machine, said predetermined distance is at least enough so that a person in proximity to said filler pipe cannot operate said pressure activated control.

9. A method for providing a sensory experience of producing a stuffed toy for a purchaser of a stuffed toy of claim 8 wherein said step of providing a distinct room further includes a two-way mirror glass wherein said purchaser may view a reflection of said stuffed toy combined with said lighting effects projected on said two-way mirror glass whereby said lighting effects apparently combine with said reflection of said stuffed toy in said two-way mirror glass.

10. A method for providing a sensory experience of producing a stuffed toy for a purchaser of a stuffed toy of claim 9 further providing a grooming area for said stuffed toy, said grooming area decorated with distinct themed decorations.

11. A method for providing a sensory experience of producing a stuffed toy for a purchaser of a stuffed toy of claim 1 further includes providing a distinct room wherein in said distinct room is means for providing lighting effects that can be projected onto a visual display of said stuffed toy.

12. A method for providing a sensory experience of producing a stuffed toy for a purchaser of a stuffed toy comprising:

(a) providing a plurality of unstuffed toy forms;

(b) allowing a purchaser to choose at least one unstuffed toy form;

(c) providing a filler pipe on a machine for stuffing said stuffed toy;

(d) stuffing said unstuffed toy form using said filler pipe on said machine;

(e) controlling said stuffing of said stuffed toy by said machine by a pressure activated control, said pressure activated control at a predetermined distance from said filler pipe on said machine said predetermined distance is at least enough so that a person in proximity to said filler pipe cannot operate said pressure activated control, said pressure activated control controlled by a purchaser of said stuffed toy;

whereby said purchaser participates in stuffing said stuffed toy by controlling said stuffing through said pressure activated control thereby enhancing said sensory experience and satisfaction of said purchaser in purchasing said stuffed toy.

13. A method for providing a sensory experience of producing a stuffed toy for a purchaser of a stuffed toy of claim 12 wherein controlling said stuffing is done by a pressure pad at said predetermined distance from said filler pipe in said machine.

14. A method for providing a sensory experience of producing a stuffed toy for a purchaser of a stuffed toy of claim 13 wherein said method further includes providing lighting and sound effects controlled by said pressure pad.

15. A method for providing a sensory experience of producing a stuffed toy for a purchaser of a stuffed toy of claim 14 further includes decorating said stuffing machine and said pressure pad with a distinct themed decorative pattern.

16. A method for providing a sensory experience of producing a stuffed toy for a purchaser of a stuffed toy of claim 15 wherein said method further provides controlling a stream of pressurized air directed at said purchaser by said pressure pad.

17. A method for providing a sensory experience of producing a stuffed toy for a purchaser of a stuffed toy comprising:

(a) providing a plurality of unstuffed toy forms;

(b) allowing a purchaser to choose at least one unstuffed toy form;

(c) providing a machine for stuffing said toy;

(d) stuffing said unstuffed toy form using said machine;

(e) providing a distinct room wherein in said distinct room is means for providing lighting effects that can be projected onto a visual display of said stuffed toy.

18. A method for providing a sensory experience of producing a stuffed toy for a purchaser of a stuffed toy of claim 17 wherein said visual display further includes providing a two-way mirror-like glass wherein said purchaser may view a reflection of said stuffed toy combined with said lighting effects projected on said two-way mirror-like glass whereby said lighting effects apparently combine with said reflection of said stuffed toy in said two-way mirror-like glass.

19. A method for providing a sensory experience of producing a stuffed toy for a purchaser of a stuffed toy of claim 18 wherein said method further includes providing sound effects coordinated with said lighting effects.

20. A method for providing a sensory experience of producing a stuffed toy for a purchaser of a stuffed toy of claim 19 wherein said providing sound effects further includes providing recorded verbal cues to said purchaser.

* * * * *